US005610935A

United States Patent [19]

Auberger

[11] Patent Number: 5,610,935

[45] Date of Patent: Mar. 11, 1997

[54] METHOD FOR MANUFACTURING A BASE ANODE FOR A METALLURGICAL VESSEL

[75] Inventor: Heinrich Auberger, Walding, Austria

[73] Assignee: Voest-Alpine Industrieanlagenbau GmbH, Austria

[21] Appl. No.: 299,535

[22] Filed: Sep. 1, 1994

[30] Foreign Application Priority Data

Sep. 6, 1993 [AT] Austria ..... 1792/93

[51] Int. Cl.[6] ..... F27D 1/00

[52] U.S. Cl. ..... 373/72; 373/45; 266/282

[58] Field of Search ..... 373/2, 45, 71, 373/72, 88, 108; 266/282

[56] References Cited

U.S. PATENT DOCUMENTS

| | | | |
|---|---|---|---|
| 4,637,033 | 1/1987 | Buhler | 373/72 |
| 4,647,022 | 3/1987 | Coble | 266/282 |
| 5,142,650 | 8/1992 | Kida et al. | 373/88 |

FOREIGN PATENT DOCUMENTS

| | | |
|---|---|---|
| 0156126 | 10/1985 | European Pat. Off. . |
| 2042309 | 9/1980 | United Kingdom . |
| 2209977 | 6/1989 | United Kingdom . |

OTHER PUBLICATIONS

"Patent Abstract of Japan", vol. 15, No. 357 (C-866). (JP.A3141174, Jun. 17, 1991).

*Primary Examiner*—Tu B. Hoang
*Attorney, Agent, or Firm*—Ostrolenk, Faber, Gerb & Soffen, LLP

[57] ABSTRACT

In a method for manufacturing a base anode (10) having a multiplicity of adjacently arranged metal elements (11) for a metallurgical vessel (1), the intermediate spaces (14) between the metal elements (11) are filled with refractory material (16), the refractory material (16) being compressed. To achieve a high degree of compression in a short period of time, the compression of the refractory material (16) takes place by means of vibration.

20 Claims, 3 Drawing Sheets

20
18
19
17'
22
23
23'

14
11
10'
27

METHOD FOR MANUFACTURING A BASE ANODE FOR A METALLURGICAL VESSEL

BACKGROUND OF THE INVENTION

The invention relates to a method for manufacturing a base anode having a plurality of adjacently arranged metal elements for a metallurgical vessel, particularly for an electric arc furnace, the intermediate spaces between the metal elements being filled with refractory material and the refractory material being compressed, and a device for implementing this method and a base anode manufactured according to the method.

In electric arc furnaces operated with direct current, the arc current flows from a graphite electrode arranged above the melt through the melt to the base anode; the electric arc furnace thus requires an electrically conducting base. Such bases come in different designs. According to one design (EP-A-0 541 044), the base is provided with metal elements which extend from the surface of the base through the refractory material as far as the metal outer casing of the electric arc furnace. There, the metal elements are fixed to an electrically conducting baseplate which is again fixed to the metal outer casing of the electric arc furnace.

The space between the metal elements, which are preferably designed as sheet steel plates (so-called "fin-type elements") extending vertically upwards from the baseplate, is filled with a refractory lining material, a magnesite lining material for example. The steel plates are arranged in the form of several concentric rings which are often composed of several sectors for base anodes of large diameter.

The intermediate spaces between the steel plates arranged in a ring shape are generally very narrow (less than 100 mm apart) and have a height extending over the entire height—this often exceeds 1 m—of the refractory lining of the base of the electric arc furnace. The problem here is that the refractory lining material can only be inserted into these narrow gaps between the adjacent steel plates with difficulty. Bridge formation and an uneven jointing of the refractory lining material can occur. This causes shrinkage cracks and porous areas through sintering, which leads to a reduced service life for the base anode and the base of the electric arc furnace.

At present the refractory lining material is inserted in layers, the lining material being manually compressed by means of rods or forks each time a layer is inserted. Five to six layers are inserted above each other, until the surface of the base of the arc furnace is reached.

This method is extremely time-consuming and labour-intensive so that the electric arc furnace is shut down for a long time when a base anode needs to be replaced. Furthermore, only a low degree of compression, which is 2.60 kg/dm$^3$ maximum even in favorable conditions (intermediate spaces which are not too narrow), can be achieved manually.

To avoid the heavy time expenditure according to this method, from pages 199 to 207 of "Radex-Rundschau", No. 4/1992, "Leitende Böden für Gleichstrom-lichtbogenöfen: Bauarten, Zustellung und feuerfeste Baustoffe" (Conducting bases for direct current arc furnaces: designs, lining and refractory materials) it is known to pour in a self-compressing refractory material between the sheet steel plates of the base anode. Although this achieves an even compression within an acceptable lining time, here again compression greater than 2.60 kg/dm$^3$ cannot be achieved. Both the heat resistance and the resistance to heat erosion leave something to be desired, so that it is still necessary to re-line and/or replace the base anode frequently.

The purpose of the invention is to avoid these disadvantages and difficulties and its object is to create a method for manufacturing a base anode for a metallurgical vessel and a device for implementing the method which enable a high degree of compression of the refractory material inserted in the base anode to be achieved in a relatively short time. In particular, the durability of the base anode should not be substantially below the durability of the lining of the metallurgical vessel surrounding the base anode and the degree of compression of the refractory material inserted into the base anode should be only slightly below the level of the maximum degree of compression for the refractory material that can be achieved in theory.

SUMMARY OF THE INVENTION

According to the invention, this object is achieved in a method of the type described above in that the compression of the refractory material takes place by vibration, it being important in the case of long and narrow intermediate spaces for the vibration of the refractory material to take place over approximately its entire height, i.e. approximately over the entire height of the metal elements.

Particularly high degrees of compression can be achieved if the vibration is carried out with a frequency of 80 to 120 Hz, preferably 100 Hz.

According to a preferred variant of the method according to the invention, a vibration means is inserted into the intermediate spaces between the metal elements, the cross-sectional shape of which is matched to the geometrical shape of the intermediate spaces between the metal elements, gaps initially remaining free between the metal elements and the vibration means, into which gaps the refractory material is inserted, whereupon and/or in the course of which vibration takes place, the insertion of the refractory material suitably taking place in at least two batches.

A further preferred variant is characterized in that the vibration means is initially inserted into the intermediate spaces between the metal elements, whereupon the gaps between the vibration means and the metal elements are filled with refractory material up to a maximum of a half, preferably up to a maximum of a third, of the height of the metal elements and that after the vibration means has been set in vibration, the vibration is maintained in the course of the insertion of the remaining refractory material and the subsequent raising of the vibration means.

For particularly narrow intermediate spaces, it is advantageous for the vibration of the refractory material to take place by setting the metal elements of the base anode in vibration, a vibration means being coupled to the metal elements of the base anode. When this method is implemented, there is less outlay on the vibration means as it does not require any components which project inbetween the metal elements of the base anode.

Considerable time and staff savings can be achieved by means of the method according to the invention and a degree of compression of the refractory material of the order of 2.9 kg/dm$^3$ can be successfully achieved, the degree of compression being uniformly high over the entire base anode. This means a very long durability of the base and hence fewer shut-down times for the metallurgical vessel.

A device for implementing the method is characterized in that the vibration means has a frame on which vibration motors are arranged and from which vibration elements project which are arranged, matched in their cross section, at the intermediate spaces between the metal elements of the base anode, the vibration elements advantageously having a length which corresponds at least approximately to the height of the metal elements of the base anode.

For a base anode whose metal elements are designed in the form of sheet metal plates which are arranged in the form of several concentrically arranged rings ("fin-type" design), the vibration elements of the vibration means are appropriately formed of sheet metal plates, which are also arranged in the form of concentrically arranged rings, which can be inserted between the sheet metal plates of the base anode.

Where flat sheet metal plates are used, the sheet metal plates of the base anode and the vibration means are advantageously arranged in the form of polygonal regular prism casings.

For base anodes with a particularly large diameter, the sheet metal plates of the base anode and the vibration means are advantageously arranged in the form of sectors which make up closed rings.

In order to ensure good oscillation and/or vibration of the sheet metal plates of the vibration means, gaps are appropriately provided between the sheet metal plates of the vibration means forming one ring or one sector.

According to a further preferred embodiment, the vibration means has a frame to which at least one vibration motor is fixed and the frame is equipped with coupling elements which can be coupled to at least a partial quantity of the metal elements of the base anode, the coupling elements advantageously being formed of slit-shaped recesses into which the free ends of the metal elements of the base anode project when the frame is placed on the metal elements.

A base anode manufactured according to the invention, which has a multiplicity of closely adjacent metal elements between which is located a refractory lining material, is characterized in that the refractory material has a degree of compression of more than 2.65 kg/dm$^3$, preferably a degree of compression of approx. 2.8. The distance between adjacent sheet metal plates can be very small, preferably less than 200 mm.

BRIEF DESCRIPTION OF THE DRAWINGS

The invention is described in greater detail below with the aid of the embodiments shown in the drawing, FIG. 1 showing a direct current electric arc furnace in vertical section and FIG. 2 a section along line II—II in FIG. 1, both in diagrammatic form.

DESCRIPTION OF THE INVENTION

Figure 1:
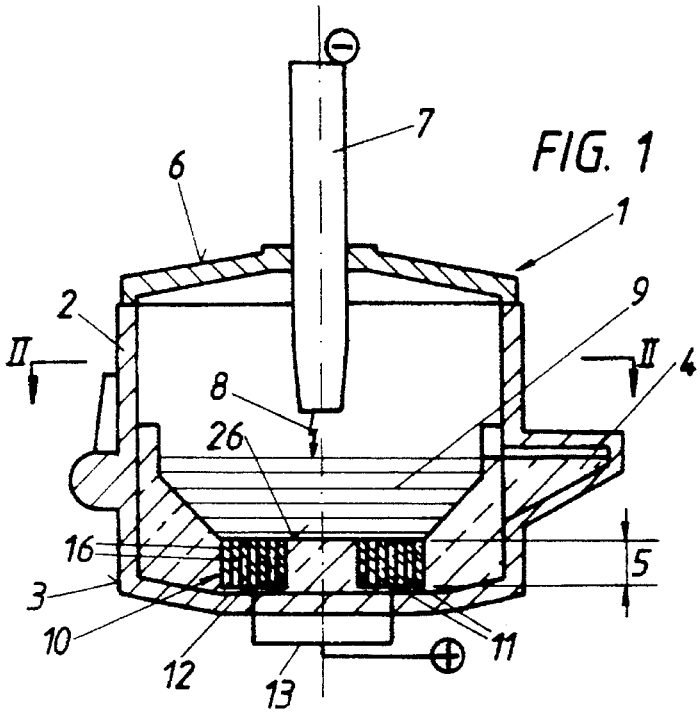
Figure 2:
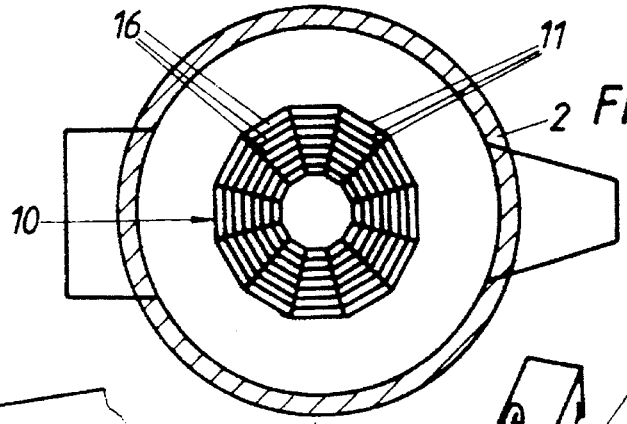

The electric arc furnace 1 shown in diagrammatic form in FIGS. 1 and 2 has a metal outer casing 2 which is provided in the lower part 3 with a refractory lining 4.

The height 5 of the refractory lining 4 in the base area is approx. 1.1 m. A graphite electrode 7 which is connected as the cathode projects centrally through the top 6 of the electric arc furnace 1. From this electrode an arc 8 burns to the melt bath 9 through which the current flows to a base anode 10. The base anode 10 is formed of annularly arranged metal elements in the form of sheet steel plates 11; it is a so-called "fin-type" anode. The sheet steel plates 11 form regular polygons which are arranged concentrically with regard to each other. The sheet steel plates 11 are welded onto base plates 12 which in their turn are bolted to the metal outer casing 2 of the electric arc furnace 1 and are connected to the power supply via copper leads 13. The metal elements could also have another shape, for example they could be rod-shaped.

Annular intermediate spaces 14 which have a width 15 of approx. 90 mm are located between the sheet steel plates 11 of the base anode 10 which have a thickness of 1.5 to 2 mm. These intermediate spaces 14 are filled with refractory material 16.

A compression device designed as a vibration means 17 serves to achieve as high as possible a degree of compression, preferably of the order of 2.8 to 2.9 and, if possible, above this. The vibration means 17 has an annular frame 18 on whose upper side several vibration motors 19 are arranged. Lugs 20 arranged on the frame 18 serve to manipulate the vibration means by means of a crane so that the vibration means 17 can be grasped and moved by means of a crane gear 21. The most favourable vibration frequency is approx. 100 Hz, and accordingly the speed of rotation of the vibration motors is approx. 6000 rpm.

At regular intervals the frame 18 has transverse ribs 22 which are aligned approximately radially, to which vibration elements in the form of sheet steel plates 23 extending vertically downwards are fixed. These sheet steel plates 23, which preferably have a thickness of approx. 5 mm, are arranged in a geometrical shape which corresponds to the geometrical shape of the annular intermediate spaces 14 between the sheet steel plates 11 of the base anode 10. Gaps 23' are present between adjacent sheet steel plates 23 in order to ensure a free oscillation of the sheet steel plates.

When the vibration means 17 is lowered into the base anode 10 initially having no refractory material 16, the sheet steel plates 23 of the vibration means 17 reach the intermediate spaces 14 between the sheet steel plates 11 of the base anode 10. The length 24 of the sheet steel plates 23 of the vibration means 17 approximately corresponds to the height 25 of the sheet steel plates 11 of the base anode 10, so that when the vibration means 17 is inserted into the base anode 10 the sheet steel plates 23 of the vibration means 17 extend over the entire height 25 of the intermediate spaces 14, although gaps remain free between the sheet steel plates 11 of the base anode 10 and the sheet steel plates 23 of the vibration means 17.

After the vibration means 17 has been inserted into the base anode 10, a part of the refractory material 16 is placed into these gaps, and in a quantity such that the base anode 10 is filled approximately up to a half, preferably up to a third full. In the course of filling or immediately thereafter, the vibration motors 19 are switched on, which causes the sheet steel plates 23 of the vibration means 17 to vibrate and the refractory material 16 to be evenly compressed.

The remaining refractory material 16 is then introduced as far as the intended base height, i.e. the internal surface 26 of the base, with the vibration motors 19 continuing to operate. After approximately 10 minutes, the vibration means 17 can be removed from the base anode 10 by means of the crane and the base anode 10 is ready. The degree of compression of the material 16 is approximately equal over the entire area of the material 16, since according to the invention the vibration takes place over the entire height of the sheet steel plates 11 of the base anode 10.

Figure 6:
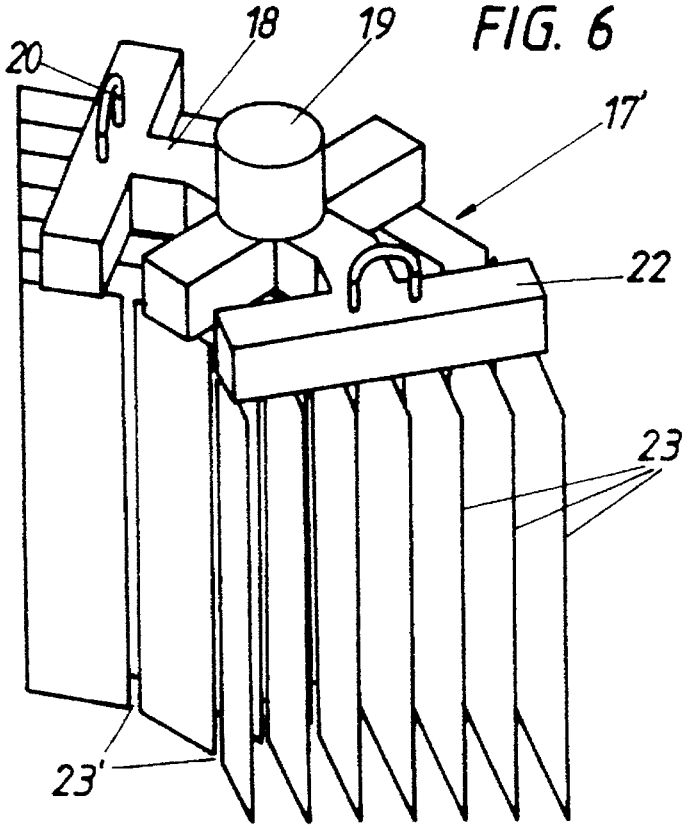
FIG. 6 shows the vibration means according to the invention for this, also in a perspective view.
Figure 5:
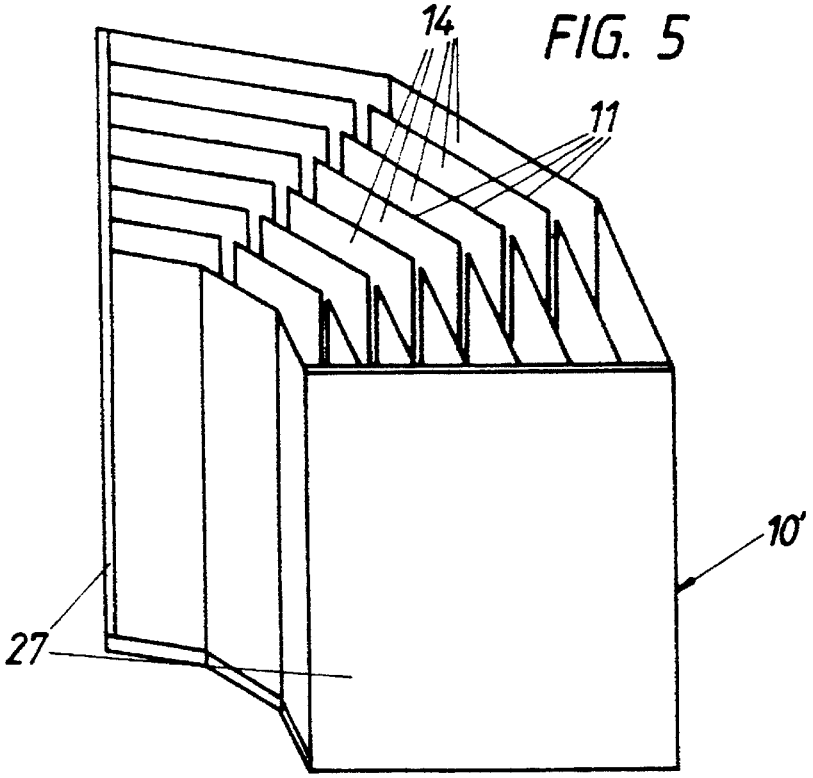
FIG. 5 shows one sector of a base anode composed of several sectors, i.e. its sheet metal components.

According to the embodiment shown in FIGS. 5 and 6 the base anode 10 is composed of four sectors 10'. The vibration means 17' is formed by a correspondingly designed partial sector. In this case, the anode sectors 10' must be closed with lateral cover plates 27 so that the refractory material cannot trickle out at the sides in the course of vibration.

Figure 8:
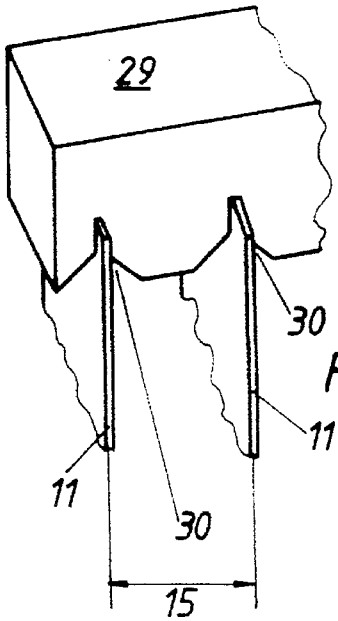
FIG. 8 shows a detail VIII of FIG. 7 of this vibration means on an enlarged scale in the course of compression.
Figure 7:
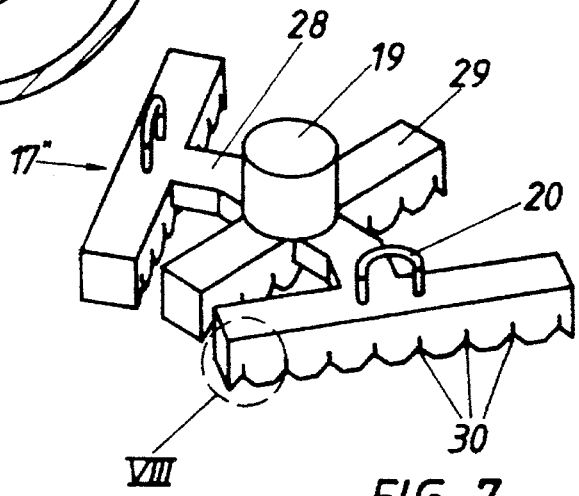
FIG. 7 shows a perspective view of a simplified embodiment of the vibration means according to the invention.
Figure 4:
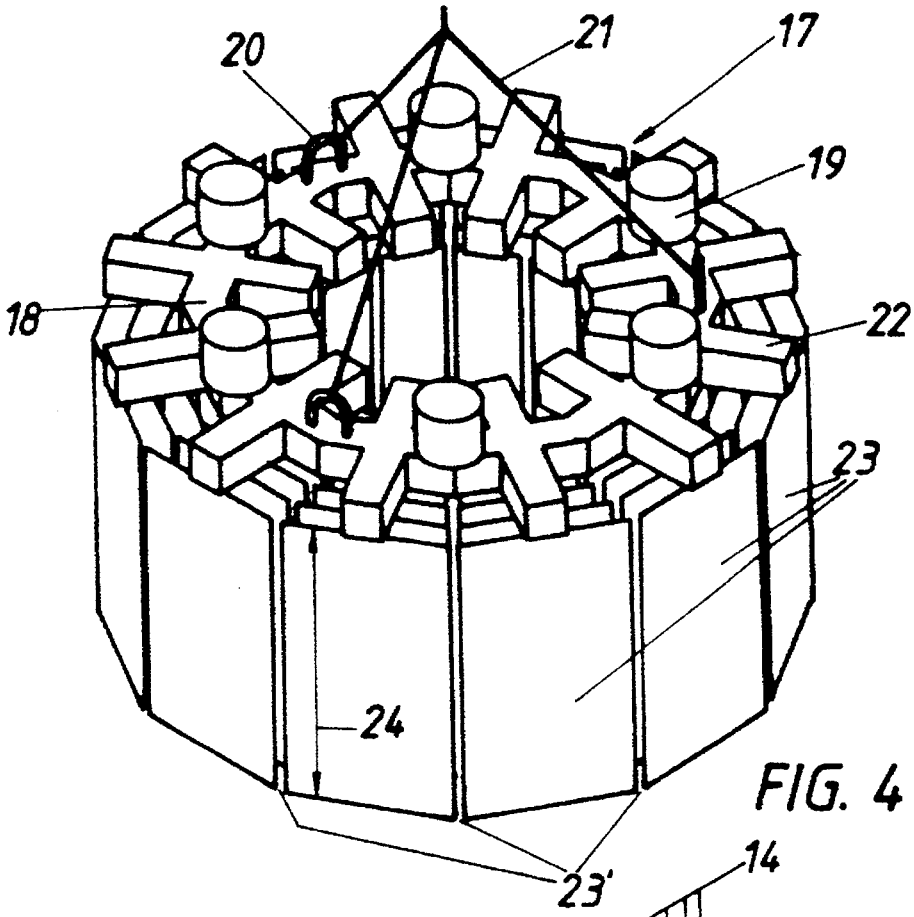
FIG. 4 shows a vibration means belonging to this design of the base anode.
Figure 3:
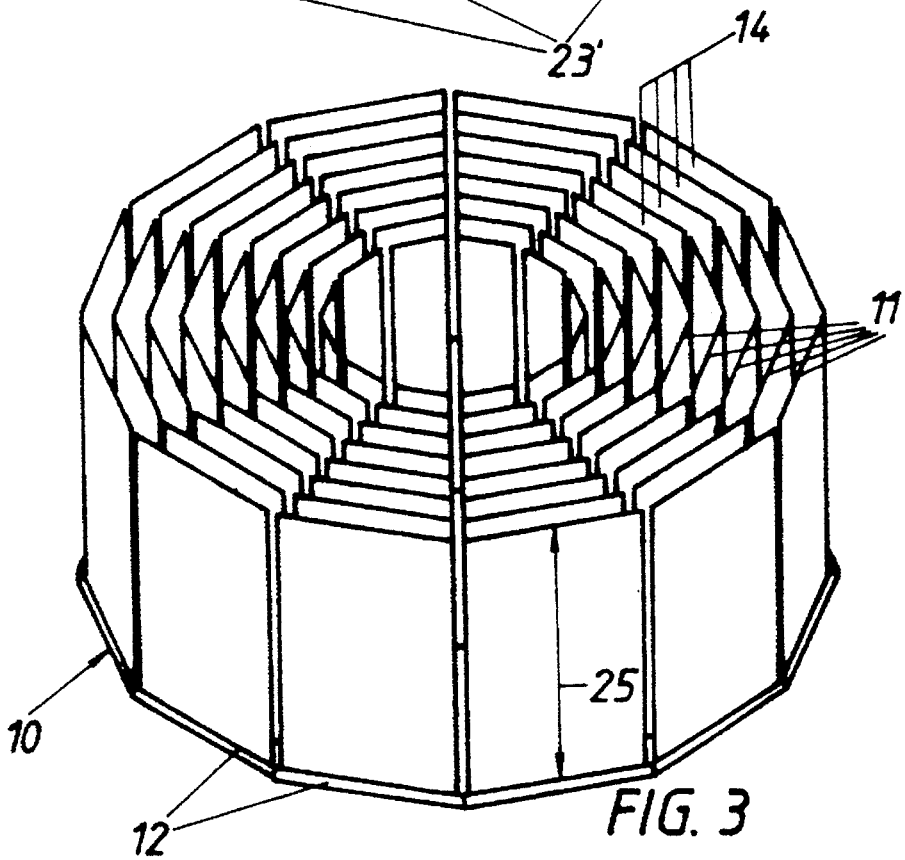
FIG. 3 shows a perspective view of a base anode of an electric arc furnace not yet filled with refractory lining material.

According to the embodiment of a vibration means 17" shown in FIGS. 7 and 8, this only has a frame 28 on which the vibration motors, only a single vibration motor 19 in the embodiment being shown, sit. The frame 28 is also provided with transverse ribs 29 which have slits 30 into which the sheet steel plates 11 of the base anode 10 project when the vibration means 17" is placed on the base anode 10. In this case the sheet steel plates 11 of the base anode 10 are set in vibratory oscillations over their entire height, which causes an approximately even compression of the inserted refractory material to take place with a high degree of compression.

I claim:

1. Method for manufacturing a base anode having a plurality of adjacently arranged metal elements for a metallurgical vessel, the method comprising the steps of:

introducing refractory material into intermediate spaces between respective metal elements; and compressing the refractory material by means of vibration.

2. Method according to claim 1, wherein the vibration is at a frequency of 80 to 120 Hz.

3. Method according to claim 1, wherein the vibration of the refractory material is effected over the entire height of the metal elements.

4. Method according to claim 1, wherein a vibration means is inserted into the intermediate spaces between the metal elements, a cross-sectional shape of the vibration means being matched to the geometrical shape of the intermediate spaces between the metal elements, gaps initially remaining free between the metal elements and the vibration means into which gaps the refractory material is inserted.

5. Method according to claim 1, wherein the refractory material is inserted in at least two batches.

6. Method according to claim 5, wherein a vibration means is initially inserted into the intermediate spaces between the metal elements, wherein gaps between the vibration means and the metal elements are filled with refractory material up to a maximum of a half of the height of the metal elements, and wherein after the vibration means has been set in vibration, the vibration is maintained during the insertion of the remaining refractory material and a subsequent removal of the vibration means.

7. Method according to claim 1, wherein the vibration of the refractory material takes place by setting the metal elements of the base anode in vibration as a result of a vibration means being coupled to the metal elements of the base anode.

8. Device for implementing the method according to claim 1, comprising a vibration means having:

a frame;

vibration motors arranged on the frame; and vibration elements projecting from the frame, which vibration elements are arranged in the intermediate spaces between the metal elements of the base anode.

9. Device according to claim 8, wherein the vibration elements have a length which corresponds to the height of the metal elements of the base anode.

10. Device according to claim 8 for a base anode in which the metal elements are in the form of sheet metal plates arranged in several concentrically-arranged rings, the vibration elements of the vibration means being formed of sheet metal plates which are arranged in the form of concentrically-arranged rings adapted to be inserted between respective sheet metal plates of the base anode.

11. Device according to claim 10, wherein the sheet metal plates of the base anode and the sheet metal plates of the vibration means respectively are arranged in the form of polygonal regular prism casings.

12. Device according to claim 10, wherein the sheet metal plates of the base anode and the sheet metal plates of the vibration means respectively are arranged in the form of a sector of a closed ring.

13. Method according to claim 2, wherein the vibration is at frequency of 100 Hz.

14. Device for implementing the method according to claim 1 wherein the vibration means has a frame to which at least one vibration motor is fixed and that the frame is equipped with coupling elements adapted to couple to at least some of the metal elements of the base anode.

15. Device according to claim 14, wherein the metal elements have free ends, and the coupling elements are formed of slit-shaped recesses into which the free ends of the metal elements of the base anode project when the frame is placed on the metal elements.

16. Base anode for a metallurgical vessel, the base anode comprising:

a multiplicity of adjacent metal elements; and a refractory material disposed between respective adjacent metal elements, the refractory material having a degree of compression of at least 2.65 $kg/dm^3$.

17. Base anode according to claim 16, wherein the adjacent metal elements comprise sheet metal plates which are arranged in the form of several concentric rings, the diametral distance from ring to ring being less than 200 mm.

18. Base anode according to claim 16, wherein the degree of compression is 2.8 $kg/dm^3$.

19. A device according to claim 8 wherein the vibration means comprises sheet metal plates, the sheet metal plates being spaced from each other such that there is a gap between respective sheet metal plates and metal elements of the base anode.

20. Method according to claim 9, wherein the metal elements are filled with refractory material up to a maximum of one-third of the height of the metal elements.

* * * * *